US007087130B2

(12) United States Patent
Wu et al.

(10) Patent No.: US 7,087,130 B2
(45) Date of Patent: Aug. 8, 2006

(54) METHOD FOR MANUFACTURING A SEALABLE BAG HAVING AN INTEGRATED ZIPPER FOR USE IN VACUUM PACKAGING

(75) Inventors: Hongyu Wu, San Jose, CA (US); Charles Wade Albritton, Hercules, CA (US); David Brakes, Hong Kong (CN)

(73) Assignee: Tilia International, Inc., San Francisco, CA (US)

( * ) Notice: Subject to any disclaimer, the term of this patent is extended or adjusted under 35 U.S.C. 154(b) by 246 days.

(21) Appl. No.: 10/794,487

(22) Filed: Mar. 4, 2004

(65) Prior Publication Data

US 2005/0070412 A1 Mar. 31, 2005

Related U.S. Application Data

(60) Provisional application No. 60/452,021, filed on Mar. 5, 2003.

(51) Int. Cl.
*B29D 7/00* (2006.01)

(52) U.S. Cl. ..... 156/204; 156/227; 156/244.25; 156/308.4

(58) Field of Classification Search ..... 156/244.25, 156/244.11, 244.16, 209, 219, 204, 227, 292, 156/308.4, 66; 264/171.23, 171.13, 210.2, 264/167

See application file for complete search history.

(56) References Cited

U.S. PATENT DOCUMENTS

| | | | |
|---|---|---|---|
| 274,447 | A | 3/1883 | Kennish |
| 1,938,593 | A | 12/1933 | Jarrier |
| 2,085,766 | A | 7/1937 | Potdevin et al. |
| 2,105,376 | A | 1/1938 | Scott |
| 2,265,075 | A | 12/1941 | Knuetter |
| 2,387,812 | A | 10/1945 | Sonneborn et al. |
| 2,429,482 | A | 10/1947 | Munters |
| 2,480,316 | A | 8/1949 | Blair et al. |
| 2,607,712 | A | 8/1952 | Sturken |
| 2,609,314 | A | 9/1952 | Engel et al. |
| 2,633,442 | A | 3/1953 | Caldwell |
| 2,642,372 | A | 6/1953 | Chittick |
| 2,670,501 | A | 3/1954 | Michiels |
| 2,690,206 | A | 9/1954 | Mueller |
| 2,695,741 | A | 11/1954 | Haley |

(Continued)

FOREIGN PATENT DOCUMENTS

| | | |
|---|---|---|
| EP | 0 723 915 | 7/1996 |

(Continued)

*Primary Examiner*—Sam Chuan Yao
*Assistant Examiner*—Barbara J. Musser
(74) *Attorney, Agent, or Firm*—Perkins Coie LLP

(57) ABSTRACT

A method for manufacturing a bag for use in vacuum packaging comprises forming a first panel having a receiving feature and a second panel having an insertion feature, such that the insertion feature can be removably connected with the receiving feature, thereby forming a zipper. Each panel comprises a gas-impermeable base layer and a heat-sealable inner layer molded from melt-extruded resin. The first panel is overlapped with the second panel, and three of four edges of the panels are heated such that the inner layers bond at the heated edges and the unbonded edge can be opened or closed via the zipper. Optionally, the bag can include a valve structure for evacuating the bag. This description is not intended to be a complete description of, or limit the scope of, the invention. Other features, aspects, and objects of the invention can be obtained from a review of the specification, the figures, and the claims.

19 Claims, 10 Drawing Sheets

U.S. PATENT DOCUMENTS

| | | | | | |
|---|---|---|---|---|---|
| 2,759,866 | A | | 8/1956 | Seymour | |
| 2,772,712 | A | | 12/1956 | Post | |
| 2,776,452 | A | | 1/1957 | Chavannes | |
| 2,778,173 | A | | 1/1957 | Taunton | |
| 2,789,609 | A | | 4/1957 | Post | |
| 2,821,338 | A | | 1/1958 | Metzger | |
| 2,856,323 | A | | 10/1958 | Gordon | |
| 2,858,247 | A | | 10/1958 | De Swart | |
| 2,913,030 | A | | 11/1959 | Fisher | |
| 2,916,411 | A | | 12/1959 | Villoresi | |
| 2,960,144 | A | | 11/1960 | Graf | |
| 3,026,231 | A | | 3/1962 | Chavannes | |
| 3,060,985 | A | | 10/1962 | Vance et al. | |
| 3,077,262 | A | | 2/1963 | Gaste | |
| 3,077,428 | A | | 2/1963 | Heuser et al. | |
| 3,098,563 | A | | 7/1963 | Skees | |
| 3,102,676 | A | | 9/1963 | Danelli et al. | |
| 3,113,715 | A | | 12/1963 | Pangrac | |
| 3,135,411 | A | | 6/1964 | Osborne | |
| 3,141,221 | A | | 7/1964 | Faulls. Jr. | |
| 3,142,599 | A | | 7/1964 | Chavannes | |
| 3,149,772 | A | | 9/1964 | Olsson | |
| 3,160,323 | A | | 12/1964 | Weisberg | |
| 3,224,574 | A | | 12/1965 | McConnell et al. | |
| 3,237,844 | A | | 3/1966 | Hughes | |
| 3,251,463 | A | | 5/1966 | Bodet | |
| 3,325,084 | A | | 6/1967 | Ausnit | |
| 3,334,805 | A | | 8/1967 | Halbach | |
| 3,381,887 | A | | 5/1968 | Lowry | |
| 3,411,698 | A | | 11/1968 | Reynolds | |
| 3,423,231 | A | | 1/1969 | Lutzmann | |
| 3,516,217 | A | | 6/1970 | Gildersleeve | |
| 3,533,548 | A | | 10/1970 | Taterka | |
| 3,565,147 | A | | 2/1971 | Ausnit | 150/3 |
| 3,575,781 | A | | 4/1971 | Pezely | |
| 3,595,467 | A | | 7/1971 | Goglio | 229/62.5 |
| 3,595,722 | A | | 7/1971 | Dawbarn | |
| 3,595,740 | A | | 7/1971 | Gerow | 161/254 |
| 3,600,267 | A | | 8/1971 | McFedries, Jr. | |
| 3,661,677 | A | | 5/1972 | Wang | 156/315 |
| 3,785,111 | A | | 1/1974 | Pike | 53/14 |
| 3,799,427 | A | | 3/1974 | Goglio | 229/62.5 |
| 3,809,217 | A | | 5/1974 | Harrison | 206/0.84 |
| 3,833,166 | A | | 9/1974 | Murray | 229/62.5 |
| 3,895,153 | A | | 7/1975 | Johnson et al. | |
| 3,908,070 | A | | 9/1975 | Marzolf | 428/474 |
| 3,937,395 | A | | 2/1976 | Lawes | 229/62.5 |
| 3,958,391 | A | | 5/1976 | Kujubu | 53/22 |
| 3,958,693 | A | | 5/1976 | Greene | 206/455 |
| 3,980,226 | A | | 9/1976 | Franz | 229/62.5 |
| 3,998,499 | A | | 12/1976 | Chiarotto | |
| 4,018,253 | A | | 4/1977 | Kaufman | 141/65 |
| 4,066,167 | A | | 1/1978 | Hanna et al. | 206/627 |
| 4,098,404 | A | | 7/1978 | Markert | 206/525 |
| 4,104,404 | A | | 8/1978 | Bieler et al. | 428/35 |
| 4,105,491 | A | | 8/1978 | Haase et al. | |
| 4,155,453 | A | | 5/1979 | Ono | 206/522 |
| 4,164,111 | A | | 8/1979 | Di Bernardo | 53/434 |
| 4,179,862 | A | | 12/1979 | Landolt | 53/86 |
| 4,186,786 | A | | 2/1980 | Kirkpatrick | 150/3 |
| 4,212,337 | A | | 7/1980 | Kamp | 150/3 |
| 4,215,725 | A | | 8/1980 | Callet et al. | 137/855 |
| 4,295,566 | A | | 10/1981 | Vincek | 206/457 |
| 4,310,118 | A | | 1/1982 | Kisida et al. | 229/62.5 |
| 4,370,187 | A | | 1/1983 | Katagiri et al. | 156/244.23 |
| 4,372,921 | A | | 2/1983 | Sanderson et al. | 422/300 |
| 4,449,243 | A | | 5/1984 | Platel | 383/103 |
| 4,486,923 | A | | 12/1984 | Briggs | 24/30.5 |
| 4,532,652 | A | | 7/1985 | Herrington | 383/103 |
| 4,551,379 | A | | 11/1985 | Kerr | 428/200 |
| 4,555,282 | A | * | 11/1985 | Yano | 156/66 |
| 4,569,712 | A | | 2/1986 | Shibano et al. | 156/244.14 |
| 4,575,990 | A | | 3/1986 | von Bismarck | 53/434 |
| 4,576,283 | A | | 3/1986 | Fafournoux | 206/524.8 |
| 4,576,285 | A | | 3/1986 | Goglio | 206/632 |
| 4,579,756 | A | | 4/1986 | Edgel | 428/34 |
| 4,583,347 | A | | 4/1986 | Nielsen | 53/434 |
| 4,658,434 | A | | 4/1987 | Murray | 383/66 |
| 4,669,124 | A | | 5/1987 | Kimura | 383/80 |
| 4,672,684 | A | | 6/1987 | Barnes et al. | 383/45 |
| 4,683,702 | A | | 8/1987 | Vis | 53/433 |
| 4,698,118 | A | * | 10/1987 | Takahashi | 156/499 |
| 4,705,174 | A | | 11/1987 | Goglio | 206/632 |
| 4,712,574 | A | | 12/1987 | Perrott | 137/217 |
| 4,741,789 | A | * | 5/1988 | Zieke et al. | 156/66 |
| 4,747,702 | A | | 5/1988 | Scheibner | 383/63 |
| 4,756,422 | A | | 7/1988 | Kristen | 206/524.8 |
| 4,756,629 | A | | 7/1988 | Tilman et al. | 383/63 |
| 4,778,282 | A | | 10/1988 | Borchardt et al. | 383/63 |
| 4,786,285 | A | | 11/1988 | Jambor | 604/342 |
| 4,812,056 | A | | 3/1989 | Zieke | 383/65 |
| 4,834,554 | A | | 5/1989 | Stetler, Jr. et al. | 383/100 |
| 4,841,603 | A | | 6/1989 | Ragni | 24/576 |
| 4,871,264 | A | | 10/1989 | Robbins, III et al. | 383/68 |
| 4,877,334 | A | | 10/1989 | Cope | 383/3 |
| 4,887,912 | A | | 12/1989 | Stumpf | 383/66 |
| 4,890,637 | A | | 1/1990 | Lamparter | 137/246 |
| 4,892,414 | A | | 1/1990 | Ausnit | 383/63 |
| 4,903,718 | A | | 2/1990 | Sullivan | 134/184 |
| 4,906,108 | A | | 3/1990 | Herrington et al. | 383/71 |
| 4,913,561 | A | | 4/1990 | Beer | 383/94 |
| 4,917,506 | A | | 4/1990 | Scheibner | 383/63 |
| 4,917,844 | A | | 4/1990 | Komai et al. | 264/85 |
| 4,941,310 | A | | 7/1990 | Kristen | 53/512 |
| 4,953,708 | A | | 9/1990 | Beer et al. | 206/632 |
| 4,973,171 | A | | 11/1990 | Bullard | 383/70 |
| 5,006,056 | A | | 4/1991 | Mainstone et al. | 425/186 |
| 5,040,904 | A | | 8/1991 | Cornwell | 583/71 |
| 5,048,269 | A | | 9/1991 | Deni | 53/512 |
| D320,549 | S | | 10/1991 | McKellar et al. | D9/311 |
| 5,053,091 | A | | 10/1991 | Giljam et al. | |
| 5,063,639 | A | | 11/1991 | Boeckmann et al. | 24/30.5 R |
| 5,080,155 | A | | 1/1992 | Crozier | 150/154 |
| 5,097,956 | A | | 3/1992 | Davis | 206/524.8 |
| 5,098,497 | A | | 3/1992 | Brinley | 156/219 |
| 5,106,688 | A | | 4/1992 | Bradfute et al. | |
| 5,111,838 | A | | 5/1992 | Langston | 137/223 |
| 5,116,444 | A | | 5/1992 | Fox | |
| 5,121,590 | A | | 6/1992 | Scanlan | 53/510 |
| 5,142,970 | A | | 9/1992 | ErkenBrack | 99/472 |
| 5,203,458 | A | | 4/1993 | Cornwell | 206/524.8 |
| 5,209,264 | A | | 5/1993 | Koyanagi | 137/852 |
| D338,399 | S | | 8/1993 | Conte, Jr. | D9/305 |
| 5,240,112 | A | | 8/1993 | Newburger | 206/524.8 |
| 5,242,516 | A | | 9/1993 | Custer et al. | 156/66 |
| 5,246,114 | A | | 9/1993 | Underwood | 206/524.8 |
| 5,252,379 | A | | 10/1993 | Kuribayashi et al. | 428/141 |
| 5,260,015 | A | * | 11/1993 | Kennedy et al. | 264/167 |
| 5,332,095 | A | | 7/1994 | Wu | 206/524.8 |
| 5,333,736 | A | | 8/1994 | Kawamura | 206/524.8 |
| 5,339,959 | A | | 8/1994 | Cornwell | 206/524.8 |
| 5,352,323 | A | | 10/1994 | Chi | 156/583.9 |
| 5,362,351 | A | | 11/1994 | Karszes | 156/243 |
| 5,368,394 | A | | 11/1994 | Scott et al. | 383/63 |
| 5,371,925 | A | | 12/1994 | Sawatsky | 24/30.5 R |
| 5,373,965 | A | | 12/1994 | Halm et al. | 222/92 |
| 5,397,182 | A | | 3/1995 | Gaible et al. | 383/63 |
| 5,402,906 | A | | 4/1995 | Brown et al. | 220/403 |
| RE34,929 | E | | 5/1995 | Kristen | 206/524.8 |
| D360,578 | S | | 7/1995 | Dees | D9/305 |
| 5,445,275 | A | | 8/1995 | Curley et al. | 206/525 |
| 5,450,963 | A | | 9/1995 | Carson | 206/524.8 |
| 5,480,030 | A | | 1/1996 | Sweeney et al. | 206/524.8 |
| 5,526,843 | A | | 6/1996 | Wolf et al. | 137/550 |

| | | | | |
|---|---|---|---|---|
| 5,540,500 | A | 7/1996 | Tanaka | 383/43 |
| 5,542,902 | A | 8/1996 | Richison et al. | 493/195 |
| 5,544,752 | A | 8/1996 | Cox | 206/524.8 |
| 5,549,944 | A | 8/1996 | Abate | |
| 5,551,213 | A | 9/1996 | Koelsch et al. | 53/434 |
| 5,554,423 | A | 9/1996 | Abate | 428/35.2 |
| 5,584,409 | A | 12/1996 | Chemberlen | 220/89.1 |
| 5,592,697 | A | 1/1997 | Young | 2/247 |
| 5,620,098 | A | 4/1997 | Boos et al. | 206/525 |
| 5,638,664 | A | 6/1997 | Levsen et al. | 53/512 |
| 5,655,273 | A | 8/1997 | Tomic et al. | 24/587 |
| 5,656,209 | A | 8/1997 | Benz et al. | |
| 5,665,456 | A | 9/1997 | Kannankeril et al. | |
| 5,689,866 | A | 11/1997 | Kasai et al. | 24/587 |
| 5,699,936 | A | 12/1997 | Sakamoto | 222/107 |
| 5,701,996 | A | 12/1997 | Goto et al. | 206/287 |
| 5,709,467 | A | 1/1998 | Galliano, II | 366/130 |
| 5,735,395 | A | 4/1998 | Lo | 206/278 |
| 5,749,493 | A | 5/1998 | Boone et al. | 222/105 |
| 5,765,608 | A | 6/1998 | Kristen | |
| 5,772,034 | A | 6/1998 | Lin | 206/522 |
| 5,812,188 | A | 9/1998 | Adair | 348/77 |
| 5,829,884 | A | 11/1998 | Yeager | 383/61 |
| 5,839,582 | A | 11/1998 | Strong et al. | 206/524.8 |
| 5,873,217 | A | 2/1999 | Smith | 53/434 |
| 5,874,155 | A | 2/1999 | Gehrke et al. | |
| 5,881,881 | A | 3/1999 | Carrington | 206/524.8 |
| 5,893,822 | A | 4/1999 | Deni et al. | 53/512 |
| 5,898,113 | A | 4/1999 | Vecere | 73/864.62 |
| 5,908,245 | A | 6/1999 | Bost et al. | 383/9 |
| 5,915,596 | A | 6/1999 | Credle, Jr. | 222/105 |
| 5,927,336 | A | 7/1999 | Tanaka et al. | 137/843 |
| 5,928,762 | A | 7/1999 | Aizawa et al. | 428/156 |
| D413,258 | S | 8/1999 | Voller | D9/305 |
| 5,931,189 | A | 8/1999 | Sweeney et al. | 137/512.15 |
| 5,941,421 | A | 8/1999 | Overman et al. | 222/105 |
| 5,941,643 | A | 8/1999 | Linkiewicz | 383/210 |
| 5,954,196 | A | 9/1999 | Lin | 206/286 |
| 5,957,831 | A | 9/1999 | Adair | 600/101 |
| 5,971,613 | A | 10/1999 | Bell | 383/107 |
| 5,996,800 | A | 12/1999 | Pratt | 206/524.8 |
| 6,017,412 | A * | 1/2000 | Van Erden et al. | 156/290 |
| 6,021,624 | A | 2/2000 | Richison et al. | 53/410 |
| 6,023,914 | A | 2/2000 | Richison et al. | 53/410 |
| 6,029,810 | A | 2/2000 | Chen | 206/287 |
| 6,030,652 | A | 2/2000 | Hanus | 426/107 |
| 6,035,769 | A | 3/2000 | Nomura et al. | 99/472 |
| 6,039,182 | A | 3/2000 | Light | 206/524.8 |
| 6,045,006 | A | 4/2000 | Frazier et al. | 222/105 |
| 6,045,264 | A | 4/2000 | Miniea | 383/41 |
| 6,053,606 | A | 4/2000 | Yamaguchi et al. | 347/86 |
| D425,786 | S | 5/2000 | Voller | D9/305 |
| 6,059,457 | A | 5/2000 | Sprehe et al. | 383/63 |
| 6,070,728 | A | 6/2000 | Overby et al. | 206/524.8 |
| 6,074,677 | A | 6/2000 | Croft | 426/124 |
| 6,076,967 | A | 6/2000 | Beaudette | 383/41 |
| 6,077,373 | A | 6/2000 | Fletcher et al. | |
| 6,089,271 | A | 7/2000 | Tani | 137/854 |
| 6,105,821 | A | 8/2000 | Christine et al. | 222/105 |
| 6,116,781 | A | 9/2000 | Skeens | 383/100 |
| 6,161,716 | A | 12/2000 | Oberhofer et al. | 220/203.04 |
| 6,164,826 | A | 12/2000 | Petkovsek | 383/210 |
| 6,202,849 | B1 | 3/2001 | Graham | 206/524.8 |
| 6,220,702 | B1 | 4/2001 | Nakamura et al. | 347/86 |
| 6,224,528 | B1 | 5/2001 | Bell | 493/196 |
| 6,227,706 | B1 | 5/2001 | Tran | 383/103 |
| 6,231,234 | B1 | 5/2001 | Gebhardt | 383/61 |
| 6,231,236 | B1 | 5/2001 | Tilman | 383/63 |
| 6,274,181 | B1 | 8/2001 | Richison et al. | 426/118 |
| D451,542 | S | 12/2001 | Ishizawa et al. | D18/56 |
| 6,357,915 | B1 | 3/2002 | Anderson | 383/100 |
| 6,402,873 | B1 | 6/2002 | Fujii et al. | 156/244.11 |
| 6,408,872 | B1 | 6/2002 | Skeens et al. | 137/512.15 |
| 6,423,356 | B1 | 7/2002 | Richison et al. | 426/118 |
| 6,520,071 | B1 | 2/2003 | Lanza | |
| 2001/0023572 | A1 | 9/2001 | Savage et al. | |
| 2004/0000501 | A1 | 1/2004 | Shah et al. | |
| 2004/0000502 | A1 | 1/2004 | Shah et al. | |
| 2004/0000503 | A1 | 1/2004 | Shah et al. | |
| 2004/0007494 | A1 | 1/2004 | Popeil et al. | |

FOREIGN PATENT DOCUMENTS

| | | |
|---|---|---|
| EP | 0 836 927 | 4/1998 |
| EP | 1 053 945 | 11/2000 |
| JP | 55-90364 | 7/1980 |
| JP | 62-192779 | 8/1987 |
| JP | 10034760 A | 2/1988 |
| JP | 7-299865 | 11/1995 |
| JP | 8-90740 | 4/1996 |
| JP | 9-131846 | 5/1997 |
| JP | 9-252919 | 9/1997 |
| JP | 10-138377 | 5/1998 |
| JP | 10-180846 | 7/1998 |
| JP | 11-77903 | 3/1999 |
| JP | 11-151142 | 6/1999 |
| JP | 11-254631 | 9/1999 |
| JP | 2000-15767 | 1/2000 |
| JP | 2000-218746 | 8/2000 |
| KR | 20-0248033 | 5/1995 |
| WO | WO 00/71422 | 11/2000 |
| WO | WO 02/28577 A2 | 4/2002 |
| WO | WO 02/066227 A1 | 8/2002 |
| WO | WO 02/074522 A1 | 9/2002 |
| WO | WO 2004/078609 | 9/2004 |

* cited by examiner

METHOD FOR MANUFACTURING A SEALABLE BAG HAVING AN INTEGRATED ZIPPER FOR USE IN VACUUM PACKAGING

PRIORITY CLAIM

This application claims priority to the following U.S. Provisional Patent Application:

U.S. Provisional Patent Application No. 60/452,021, entitled "METHOD FOR MANUFACTURING A SEALABLE BAG HAVING AN INTEGRATED ZIPPER FOR USE IN VACUUM PACKAGING," by Henry Wu, et al., filed Mar. 5, 2003.

CROSS-REFERENCE TO RELATED PATENT APPLICATIONS

This U.S. Patent Application incorporates by reference all of the following co-pending applications:

U.S. Provisional Patent Application No. 60/452,168, entitled "LIQUID-TRAPPING BAG FOR USE IN VACUUM PACKAGING," by Henry Wu, et al., filed Mar. 5, 2003 (Attorney Docket No. TILA-01177US0);

U.S. Provisional Patent Application No. 60/452,138, entitled "METHOD FOR MANUFACTURING LIQUID-TRAPPING BAG FOR USE IN VACUUM PACKAGING," by Henry Wu, et al., filed Mar. 5, 2003 (Attorney Docket No. TILA-01177US1);

U.S. Provisional Patent Application No. 60/452,172, entitled "SEALABLE BAG HAVING AN INTEGRATED TRAY FOR USE IN VACUUM PACKAGING," by Henry Wu, et al., filed Mar. 5, 2003 (Attorney Docket No. TILA-01178US0);

U.S. Provisional Patent Application No. 60/452,171, entitled "METHOD FOR MANUFACTURING A SEALABLE BAG HAVING AN INTEGRATED TRAY FOR USE IN VACUUM PACKAGING," by Henry Wu, et al., filed Mar. 5, 2003 (Attorney Docket No. TILA-01178US1);

U.S. Provisional Patent Application No. 60/451,954, entitled "SEALABLE BAG HAVING AN INDICIA FOR USE IN VACUUM PACKAGING," by Henry Wu, et al., filed Mar. 5, 2003 (Attorney Docket No. TILA-01179US0);

U.S. Provisional Patent Application No. 60/451,948, entitled "METHOD FOR MANUFACTURING A SEALABLE BAG HAVING AN INDICIA FOR USE IN VACUUM PACKAGING," by Henry Wu, et al., filed Mar. 5, 2003 (Attorney Docket No. TILA-01179US1);

U.S. Provisional Patent Application No. 60/452,142, entitled "SEALABLE BAG HAVING AN INTEGRATED ZIPPER FOR USE IN VACUUM PACKAGING," by Henry Wu, et al., filed Mar. 5, 2003 (Attorney Docket No. TILA-01180US0);

U.S. Provisional Patent Application No. 60/451,955, entitled "SEALABLE BAG HAVING AN INTEGRATED VALVE STRUCTURE FOR USE IN VACUUM PACKAGING," by Henry Wu, et al., filed Mar. 5, 2003 (Attorney Docket No. TILA-01181US0);

U.S. Provisional Patent Application No. 60/451,956, entitled "METHOD FOR MANUFACTURING SEALABLE BAG HAVING AN INTEGRATED VALVE STRUCTURE FOR USE IN VACUUM PACKAGING," by Henry Wu, et al., filed Mar. 5, 2003 (Attorney Docket No. TILA-01181US1);

U.S. Provisional Patent Application No. 60/452,157, entitled "SEALABLE BAG HAVING AN INTEGRATED TIMER/SENSOR FOR USE IN VACUUM PACKAGING," by Henry Wu, et al., filed Mar. 5, 2003 (Attorney Docket No. TILA-01182US0);

U.S. Provisional Patent Application No. 60/452,139, entitled "METHOD FOR MANUFACTURING A SEALABLE BAG HAVING AN INTEGRATED TIMER/SENSOR FOR USE IN VACUUM PACKAGING," by Henry Wu, et al., filed Mar. 5, 2003 (Attorney Docket No. TILA-01182US1);

U.S. patent application Ser. No. 10/169,485, entitled "METHOD FOR PREPARING AIR CHANNEL EQUIPPED FILM FOR USE IN VACUUM PACKAGE," filed Jun. 26, 2002;

U.S. Patent Application No. 60/452,171, entitled "LIQUID-TRAPPING BAG FOR USE IN VACUUM PACKAGING," Attorney Docket No. TILA-01177US2, filed concurrently;

U.S. Patent Application No. 60/452,138, entitled "METHOD FOR MANUFACTURING LIQUID-TRAPPING BAG FOR USE IN VACUUM PACKAGING," Attorney Docket No. TILA-01177US3, filed concurrently;

U.S. Patent Application No. 60/452,172, entitled "SEALABLE BAG HAVING AN INTEGRATED TRAY FOR USE IN VACUUM PACKAGING," Attorney Docket No. TILA-01178US2, filed concurrently;

U.S. Patent Application No. 60/452,171, entitled "METHOD FOR MANUFACTURING A SEALABLE BAG HAVING AN INTEGRATED TRAY FOR USE IN VACUUM PACKAGING," Attorney Docket No. TILA-01178US3, filed concurrently;

U.S. Patent Application No. 60/451,954, entitled "SEALABLE BAG HAVING AN INDICIA FOR USE IN VACUUM PACKAGING," Attorney Docket No. TILA-01179US2, filed concurrently;

U.S. Patent Application No. 60/451,948, entitled "METHOD FOR MANUFACTURING A SEALABLE BAG HAVING AN INDICIA FOR USE IN VACUUM PACKAGING," Attorney Docket No. TILA-01179US3, filed concurrently;

U.S. Patent Application No. 60/452,142, entitled "SEALABLE BAG HAVING AN INTEGRATED ZIPPER FOR USE IN VACUUM PACKAGING," Attorney Docket No. TILA-01180US2, filed concurrently;

U.S. Patent Application No. 60/451,955, entitled "SEALABLE BAG HAVING AN INTEGRATED VALVE STRUCTURE FOR USE IN VACUUM PACKAGING," Attorney Docket No. TILA-01181US2, filed concurrently;

U.S. Patent Application No. 60/451,956, entitled "METHOD FOR MANUFACTURING A SEALABLE BAG HAVING AN INTEGRATED VALVE STRUCTURE FOR USE IN VACUUM PACKAGING," Attorney Docket No. TILA-01181US3, filed concurrently;

U.S. Patent Application No. 60/452,157, entitled "SEALABLE BAG HAVING AN INTEGRATED TIMER/SENSOR FOR USE IN VACUUM PACKAGING," Attorney Docket No. TILA-01182US2, filed concurrently; and U.S. Patent Application No. 60/452,139, entitled "METHOD FOR MANUFACTURING A SEALABLE BAG HAVING AN INTEGRATED TIMER/SENSOR FOR USE IN VACUUM PACKAGING," Attorney Docket No. TILA-01182US3, filed concurrently.

FIELD OF THE INVENTION

The present invention relates to bags for use in vacuum packaging and methods and devices for manufacturing bags for use in vacuum packaging.

BACKGROUND

Methods and devices for preserving perishable foods such as fish and meats, processed foods, prepared meals, and left-overs, and non-perishable items are widely known, and widely varied. Foods are perishable because organisms such as bacteria, fungus and mold grow over time after a food container is opened and the food is left exposed to the atmosphere. Most methods and devices preserve food by protecting food from organism-filled air. A common method and device includes placing food into a gas-impermeable plastic bag, evacuating the air from the bag using suction from a vacuum pump or other suction source, and tightly sealing the bag.

A bag for use in vacuum packaging can consist of a first panel and second panel, each panel consisting of a single layer of heat-sealable, plastic-based film (for example, polyethylene). The panels are sealed together along a substantial portion of the periphery of the panels by heat-sealing techniques so as to form an envelope. Perishable products, such as spoilable food, or other products are packed into the envelope via the unsealed portion through which air is subsequently evacuated. After perishable products are packed into the bag and air is evacuated from the inside of the bag, the unsealed portion is heated and pressed such that the panels adhere to each other, sealing the bag.

U.S. Pat. No. 2,778,173, incorporated herein by reference, discloses a method for improving the evacuation of air from the bag by forming channels in at least one of the panels with the aid of embossing techniques. Air escapes from the bag along the channels during evacuation. The embossing forms a pattern of protuberances on at least one of the panels. The protuberances can be discrete pyramids, hemispheres, etc., and are formed by pressing a panel using heated female and male dies. The first panel is overlaid on the second panel such that the protuberances from one panel face the opposite panel. The contacting peripheral edges of the panels are sealed to each other to form an envelope having an inlet at an unsealed portion of the periphery. The perishable or other products are packed into the envelope through the inlet, and the inlet is sealed. Thereafter, an opening is pierced in a part of the panel material that communicates with the channels, air is removed from the interior of the envelope through the channels and opening, and the opening is sealed. This type of bag requires two additional sealing steps after the perishable or other product is packed into the envelope. One further problem is that embossing creates impressions on the plastic such that indentations are formed on the opposite side of the panel To avoid additional sealing steps, a vacuum bag is formed having a first panel and a second panel consisting of laminated films. Each panel comprises a heat-sealable inner layer, a gas-impermeable outer layer, and optionally, one or more intermediate layers. Such a bag is desired in U.S. Pat. No. Re. 34,929, incorporated herein by reference. At least one film from at least one panel is embossed using an embossing mold to form protuberances and channels defined by the space between protuberances, so that air is readily evacuated from the vacuum bag.

U.S. Pat. No. 5,554,423, incorporated herein by reference, discloses still another bag usable in vacuum packaging. The bag consists of a first and second panel, each panel consisting of a gas-impermeable outer layer and a heat-sealable inner layer. A plurality of heat-sealable strand elements are heat bonded at regular intervals to the inner layer of either the first panel or the second panel. The spaces between strand elements act as channels for the evacuation of air. The strand elements are extruded from an extrusion head and heat bonded to the heat-sealable layer by use of pressure rolls. Separate equipment is required for producing strand elements, and a procedure of heat bonding a plurality of strand elements at regular intervals to the heat-sealable inner layer is complicated. Also, various shapes of pattern are hard to form using this process.

BRIEF DESCRIPTION OF THE FIGURES

Further details of embodiments of the present invention are explained with the help of the attached drawings in which.

DETAILED DESCRIPTION

Figure 1A:
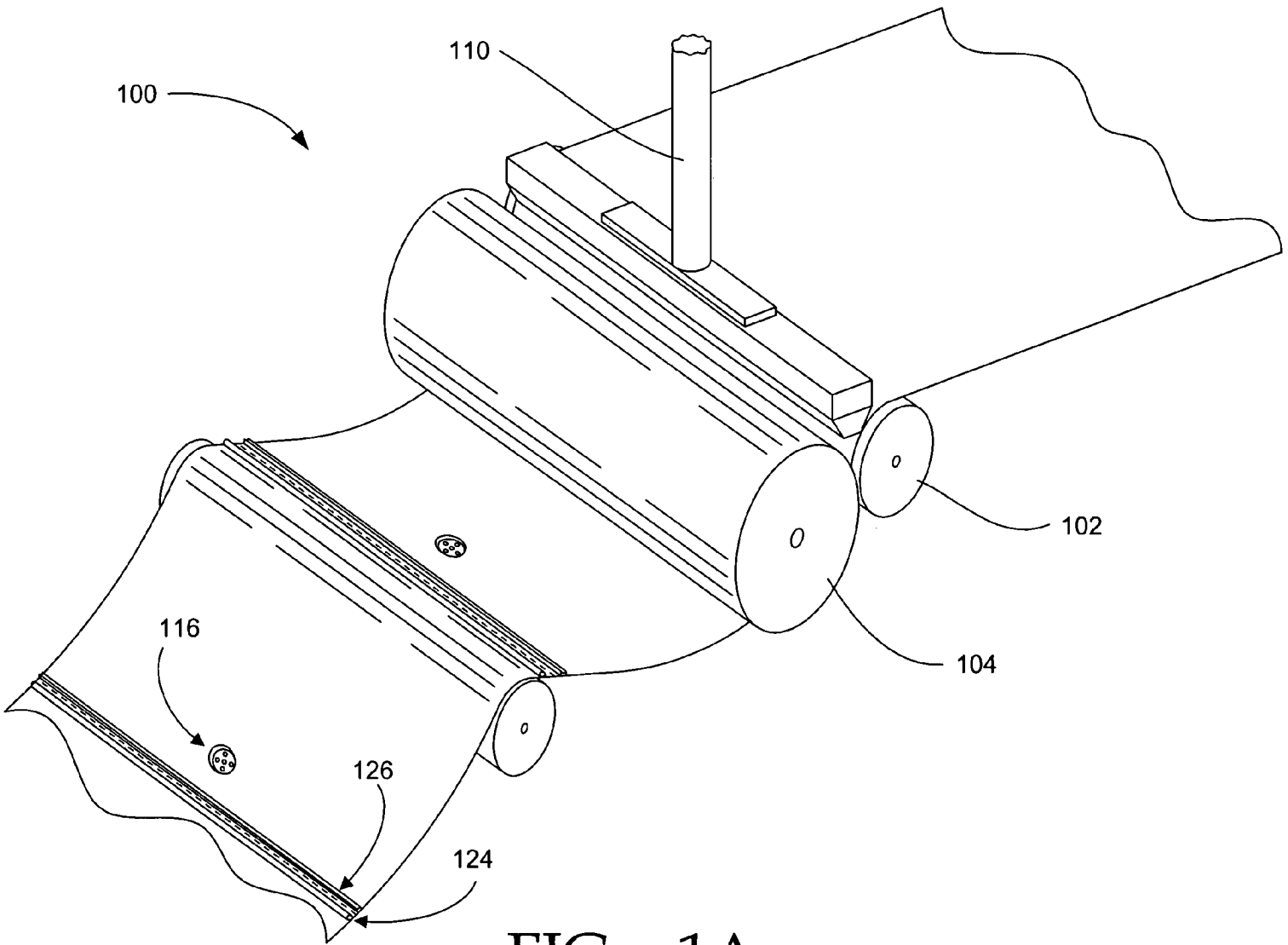
FIG. 1A is a perspective view of a method for manufacturing a vacuum bag in accordance with one embodiment of the present invention.

FIGS. 1A–D illustrate one embodiment of a method for manufacturing a vacuum bag in accordance with the present invention. The vacuum bag comprises a first panel and a second panel, wherein each panel comprises a gas-impermeable base layer 108 and a heat-sealable inner layer 106 with one panel having a receiving feature 126 and one panel having an insertion feature 124, the receiving feature and insertion feature together forming a zipper or clasp for sealing the vacuum bag. At least one of the panels can also include a valve structure 116 for evacuating the vacuum bag.

Figure 1B:
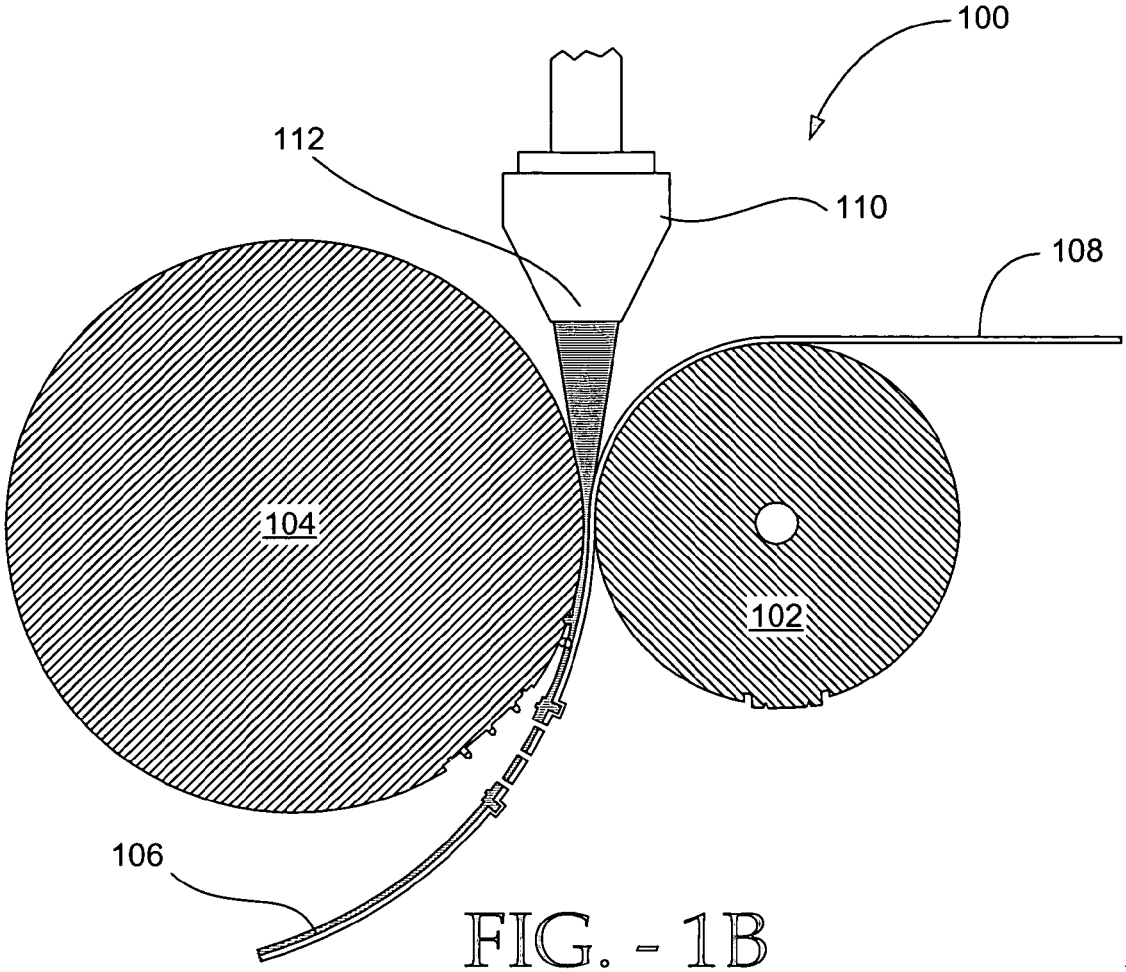
FIG. 1B is a side view of the method shown in FIG. 1A illustrating the embossing method used in an embodiment of the present invention.

A laminating roll 102 and a cooling roll 104 are arranged so that the heat-sealable inner layer 106 can be laminated to the gas-impermeable base layer 108 as the melt-extruded resin is cooled. As illustrated in FIG. 1B, the gap between the laminating roll 102 and the cooling roll 104 can be controlled according to specifications (for example, thickness) of a panel for use in vacuum packaging. The temperature of the cooling roll 104 is maintained in a range such that the melt-extruded resin is sufficiently cooled to form the desired pattern. For example, a temperature range of about −15° C. to about −10° C. can be sufficient to properly form the desired pattern. The temperature range of the cooling roll 104 can vary according to the composition of the resin, the composition of the gas-impermeable base layer 108, environmental conditions, etc. and can require calibration. Also, the cooling roll 104 can be sized to have a larger diameter than the laminating roll 102, thereby bringing the melt-extruded resin into contact with more cooled surface area. For example, the diameter of the cooling roll 104 can be about one-and-a-half to about three times as large (or more) as that of the laminating roll 102.

The heat-sealable inner layer 106 typically comprises a thermoplastic resin. For example, the heat-sealable inner layer can be comprised of polyethylene (PE) suitable for preserving foods and harmless to a human body. A vacuum bag can be manufactured by overlapping a first panel with a second panel such that the heat-sealable inner layers 106 of the two panels are brought into contact, and by thereafter heating a portion of the periphery of the panels to form an envelope. The thermoplastic resin can be chosen so that the two panels strongly bond to each other when sufficient heat is applied.

The gas-impermeable base layer 108 is fed to the gap between the cooling roll 104 and the laminating roll 102 by a feeding means (not shown). The gas-impermeable base layer can be comprised of polyester, polyamide, ethylene vinyl alcohol (EVOH), nylon, or other material having similar properties and capable of being used in this manufacturing process, and also capable of being heated. The gas-impermeable base layer 108 can consist of one layer, or two or more layers. When employing a multilayer-structured base layer, it should be understood that a total thickness thereof is also adjusted within the allowable range for the total gas-impermeable base layer 108.

An extruder 110 is positioned in such a way that the melt-extruded resin is layered on the gas-impermeable base layer 108 by feeding the melt-extruded resin to the nip between the cooling roll 104 and the gas-impermeable layer 108. The resin is fed through a nozzle 112 of the extruder 110. The temperature of the melt-extruded resin is dependent on the type of resin used, and can typically range from about 200° C. to about 250° C. The amount of resin to be extruded into the laminating unit 100 is dependent on the desired thickness of the heat-sealable inner layer 106.

Figure 1C:
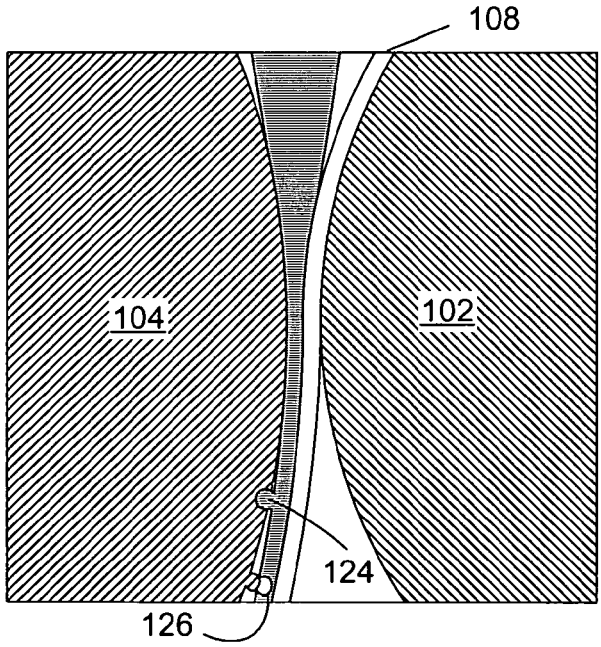
FIG. 1C is a close-up view of a portion of FIG. 1B for forming a receiving feature and an insertion feature.
Figure 2A:
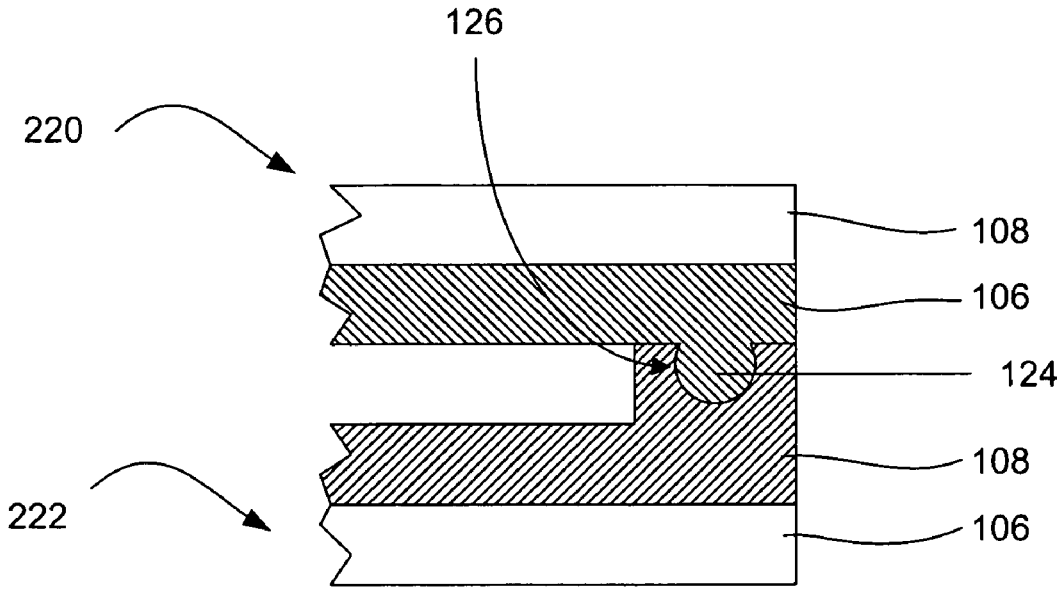
FIGS. 2A and 2B are cross-sections of portions of exemplary first panels overlapping exemplary second panels in accordance with embodiments of the present invention, manufactured by the process shown in FIGS. 1A–C.
Figure 2B:
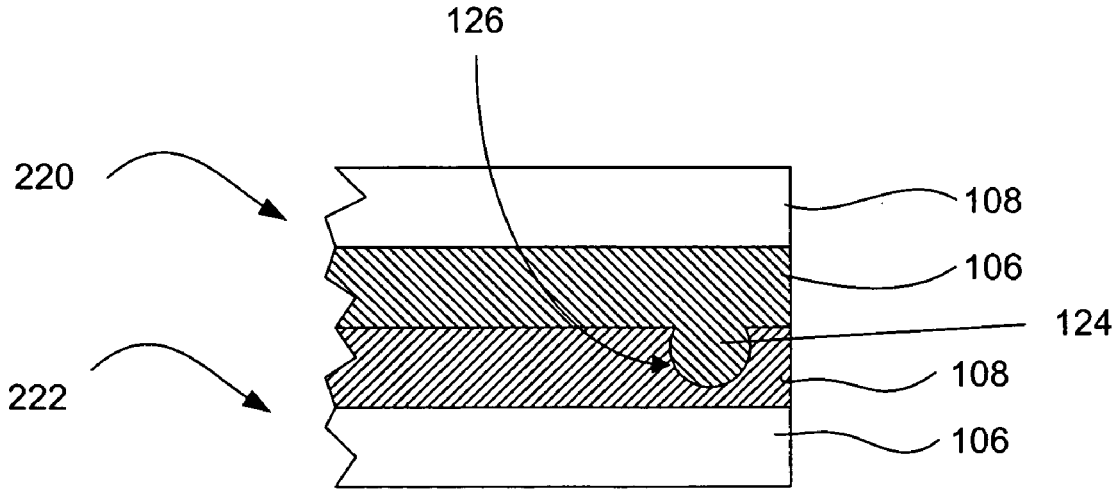
Figure 2C:
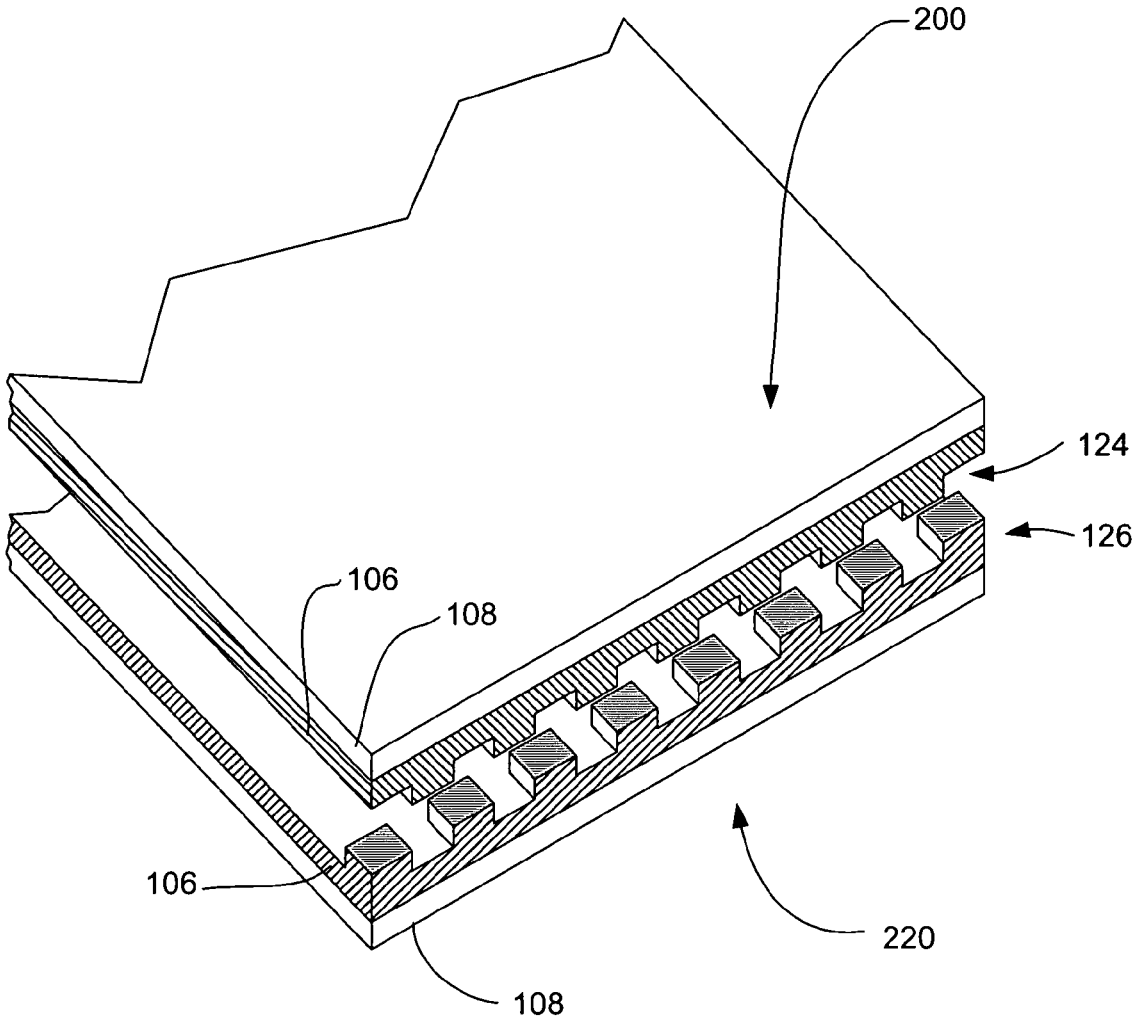
FIG. 2C is a perspective cross-section of a portion of an exemplary first panel overlapping a portion of exemplary second panel in accordance with an alternative embodiment of the present invention.

As shown partially in FIG. 1C, portions of a circumferential surface of the cooling roll 104 in accordance with one embodiment of the present invention can include cavities 184 corresponding to insertion features and/or protuberances corresponding to receiving features. The resin extruded from the nozzle 112 is pressed between the cooling roll 104 and the gas-impermeable base layer 108 and flows into the cavities 184 corresponding to insertion features, while being forced out of spaces corresponding to receiving features. In other embodiments, both the insertion features and receiving features can correspond to cavities 184. The resin quickly cools and solidifies in the desired pattern while adhering to the gas-impermeable base layer 108, thereby forming the heat sealable inner layer 106 of the panel as shown in FIGS. 2A–C. The heat-sealable inner layer 106 can be formed while the resin is sufficiently heated to allow the resin to flow, thereby molding the resin, unlike other methods adopting a post-embossing treatment where the heat-sealable inner layer is drawn by a die or embossed between male and female components.

Figure 1D:
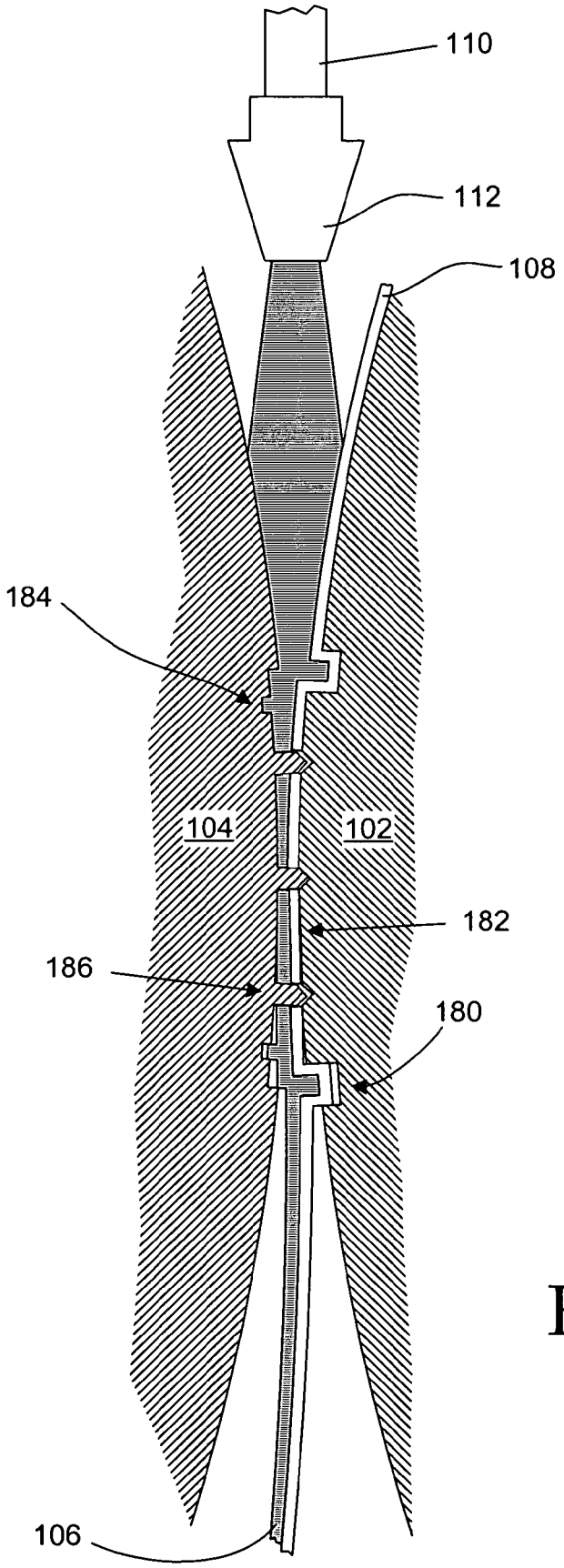
FIG. 1D is a close-up view of a portion of FIG. 1B for forming a valve structure.
Figure 2D:
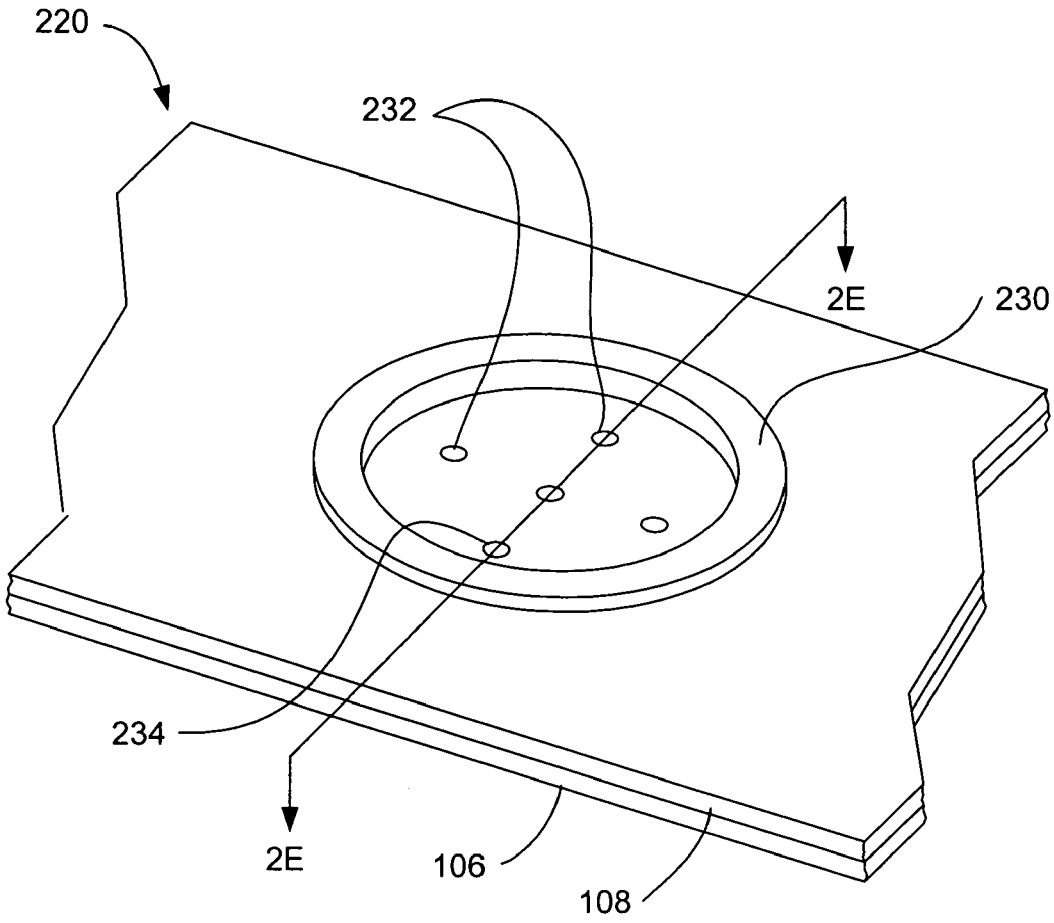
FIG. 2D is a perspective view of a portion of a first panel having a valve structure in accordance with one embodiment of the present invention, manufactured by the process shown in FIGS. 1A, 1B, and 1D.
Figure 2E:
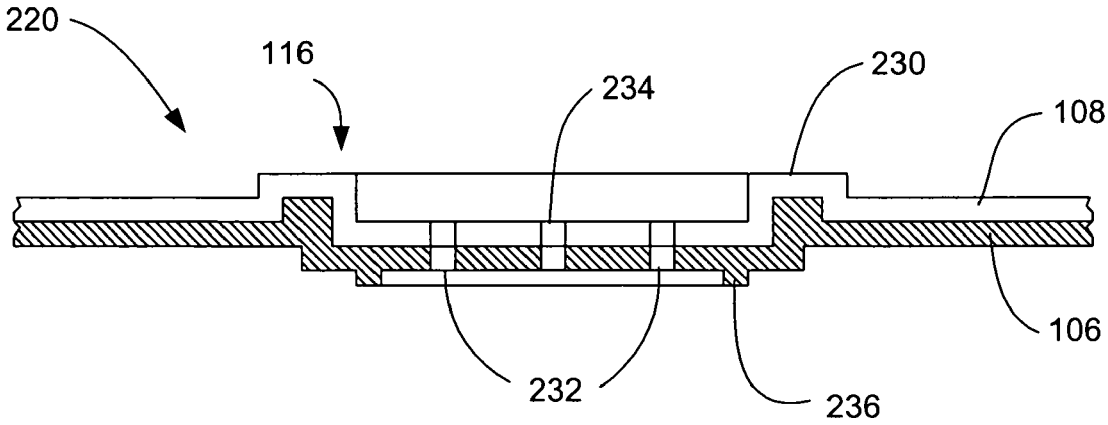
FIG. 2E is a cross-section of the portion of a first panel shown in FIG. 2D.

As shown partially in FIG. 1D, portions of the circumferential surface of the cooling roll 104 can additionally include, or can alternatively include, protuberances 186 and/or cavities 184 for forming a complicated structure, such as a valve structure 116. The resin extruded from the nozzle 112 is pressed between the cooling roll 104 and the gas-impermeable base layer 108. The resin flows into the cavities of the cooling roll 104 and is squeezed out where protuberances of the cooling roll 104 press into the resin. A circumferential surface of the laminating roll 102 can also, if desired, have cavities 180 and/or protuberances 182 for further defining features of the valve structure 116. As the melt-extruded resin is pressed between the cooling roll 104 and laminating roll 102, the resin forces the gas-impermeable layer 108 to conform to the textured contour of the laminating roll 102. The resin quickly cools and solidifies in the desired pattern while adhering to the gas-impermeable base layer 108, thereby forming the heat-sealable inner layer 106 of the panel 220 as shown in FIGS. 2D and 2E. The circumferential surfaces of the cooling rolls 104 described above can optionally include protuberances for forming perforations (not shown), such that a bag can be separated from a roll of bags by a customer.

A laminating roll 102 having cavities 180 and/or protuberances 182 can have a circumference that is an integer multiple of the circumference of the cooling roll 104, thereby defining a minimum number of panels produced in one rotation of the cooling roll 104. For example, where a cooling roll 104 having a 36 inch circumference is used, the laminating roll 102 can have a circumference of 36 inches, 24 inches, 12 inches, etc., such that the circumference of the laminating roll 102 limits the maximum size of the bag.

The thickness (or depth) of each receiving or insertion feature formed on the heat-sealable inner layer of a panel 220 can be determined by the depth of the cavities or the height of the protuberances of the cooling roll 104. The dimensions of the valve structure formed on the heat-sealable resin layer of a panel 220 can be determined by the depth of the cavities and the height of the protuberances of the cooling roll 104 and the laminating roll 102. Thus, the shape, width, and thickness of the panels can be controlled by changing the specifications for the protuberances and cavities on one or both of the two rolls.

FIG. 2A illustrates a cross-section of two panels 220,222 in accordance with one embodiment of the present invention wherein the cavities of the cooling roll 104 correspond to an insertion feature 124 on the heat-sealable inner layer 106, and wherein protuberances on other portions of the cooling roll 104, or on a second cooling roll 104 correspond to a receiving feature 126 on the heat-sealable inner layer 106. The receiving feature 126 is shaped to receive the insertion feature 124, such that the features can be removably joined. Where the insertion feature 124 and receiving feature 126 are molded from the same cooling roll 104, a single panel is folded over itself to form two panels 220,222. Alternatively, each panel 220,222 can be formed separately using separate cooling rolls 104. The features 124,126 form a zipper or clasp adapted for sealing the bag.

In an alternative embodiment shown in FIG. 2B, cavities of the cooling roll 104 correspond to both an insertion feature 124 and a receiving feature 126. The receiving feature 126 is a protruding jaw shaped for receiving the insertion feature 124, such that the features can be removably joined. The features 124,126 form a zipper or clasp adapted for sealing the bag. As described above, the features 124,126 can be molded by a single cooling roll 104, or by two different cooling rolls 104

FIG. 2C is a perspective view of a cross-section of two panels 220, 222 in accordance with still another embodiment of the present invention wherein cavities in the cooling roll 104 form protuberances corresponding to "teeth" 124 on the heat-sealable inner layer 106 for each panel, such that the teeth on a first panel 220 are offset from the teeth of a second panel 222, so that the teeth mate. The teeth 124 form a zipper adapted for sealing the bag. One of ordinary skill in the art can appreciate the different methods for forming mating components on two panels 220,222 such that a seal can be created and can appreciate the myriad of different feature geometries and arrangements for zipping or clasping a vacuum bag in accordance with the present invention.

The heat-sealable inner layer 106 can range from 0.5–6.0 mils in thickness and each insertion or receiving feature 124,126 can range from 0.5–8.0 mils in thickness, while the gas-impermeable base layer 108 can range from about 0.5–8.0 mils in thickness. The dimensions of the resin layer 106 and the base layer 108 are set forth to illustrate, but are not to be construed to limit the dimensions. In other embodiments, each panel 220,222 can include one or more receiving features 126 and/or one or more insertion features 124 such that the respective features of a first panel 220 mate with the respective features of a second panel 222.

FIG. 2D is a perspective view of a portion of the panel 220 formed by the cooling roll 104 in which the heat-sealable inner layer 106 is molded in such a way that a valve structure 116 is formed in accordance with one embodiment of the present invention. The panel 220 can include a valve collar 230 for connecting a vacuum attachment with the valve structure 116 such that the vacuum attachment does not slide across the surface of the panel 220. The panel 220 can also include at least one aperture 232 for drawing air and/or other gases from the bag during evacuation of the bag, and at least one attachment point 234 for connecting a diaphragm with the valve structure 116. The cooling roll 104 can include pointed protuberances that extend as shown in FIG. 1D such that the protuberances pierce the gas-impermeable layer and are received in indentations of the laminating roll 102 when forming the at least one aperture 232. The apertures 232 are shown in FIGS. 2D and 2E to be circular in shape and positioned equidistant from the center of the valve structure 116, but in other embodiments can have different shapes and can be arranged in different patterns. FIG. 2E is a cross-section of the valve structure 116 shown in FIG. 2D, showing stiffeners 236 adapted for preventing portions of the bag from being sucked into any of the apertures 232 during evacuation and for providing additional rigidity to the valve structure. In the embodiment shown in FIG. 2E, the stiffeners 236 extend from the valve structure 116 on the underside of the valve and are positioned as a ring located about the apertures 232. However, in other embodiments the stiffeners 236 can have various other geometries or can be absent.

Figure 3:
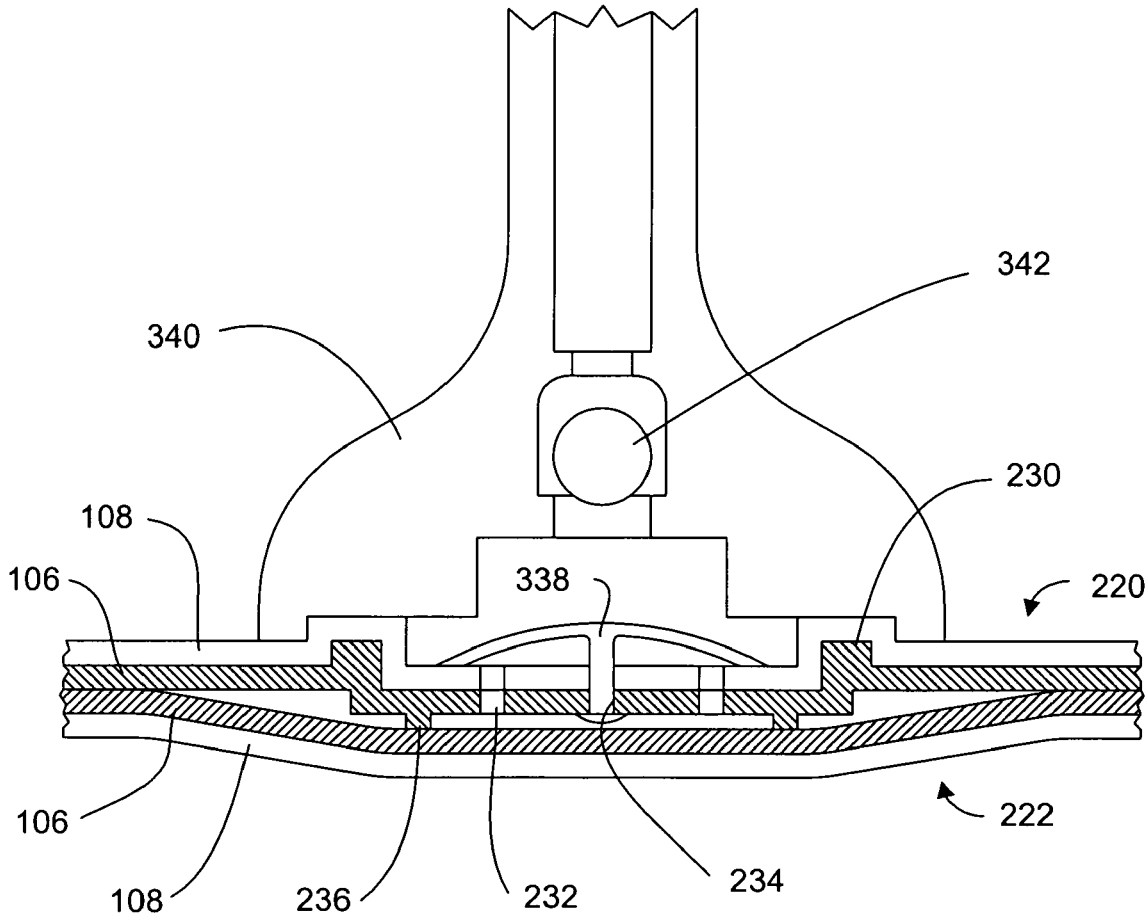
FIG. 3 is a cross-section of a vacuum attachment connected with a portion of a vacuum bag and a diaphragm connected with the valve structure of FIGS. 2D and 2E.

FIG. 3 is a cross-section of a portion of a vacuum bag 350 including a valve structure in accordance with one embodiment of the present invention. A diaphragm 338 can be connected with the bag 350 via the attachment point 234. The diaphragm 338 can comprise a deformable material, for example rubber, such that a seal can be formed when a pressure differential between the inside and outside of the bag 350 creates suction on the diaphragm 338, drawing the diaphragm 338 toward the one or more apertures 232, but wherein the seal can be broken when a user places his finger between the diaphragm 338 and the valve structure 116, or when a pressure differential creates suction on the diaphragm 338 drawing the diaphragm 338 away from the one or more apertures 232. The diaphragm 338 can be dome-shaped, as shown in FIG. 3, or can be flat. A vacuum attachment 340 can be positioned around the valve collar 230 and air and/or other gases can be evacuated from the bag 350 by suction created by a vacuum source (not shown) connected with the vacuum attachment 340. The vacuum attachment 340 can optionally include a check valve 342 for preventing liquids from being drawn into the vacuum source. Once the bag 350 has been sufficiently evacuated to suit the user's needs, the vacuum source is removed and the diaphragm 338 is drawn toward the one or more apertures 232 such that a seal is formed and the bag 350 remains partially or fully evacuated. The vacuum attachment 340 can be removed and the bag 350 stored for later use.

The heat-sealable inner layer 106 can range from 0.5–6.0 mils in thickness and the valve structure 116 can range from 0.5–80.0 mils or more in thickness, while the gas-impermeable base layer 108 can range from about 0.5–8.0 mils in thickness. The dimensions of the resin layer 106 and the base layer 108 are set forth to illustrate, but are not to be construed to limit the dimensions.

In other embodiments, the valve structure 116 can be a simple flat structure having one or more apertures 232 and one or more attachment points 234, thereby eliminating the need for a laminating roll 102 having surface topography, simplifying the manufacturing process. One of ordinary skill in the art can appreciate the myriad of different shapes and features a valve structure can have.

Figure 4A:
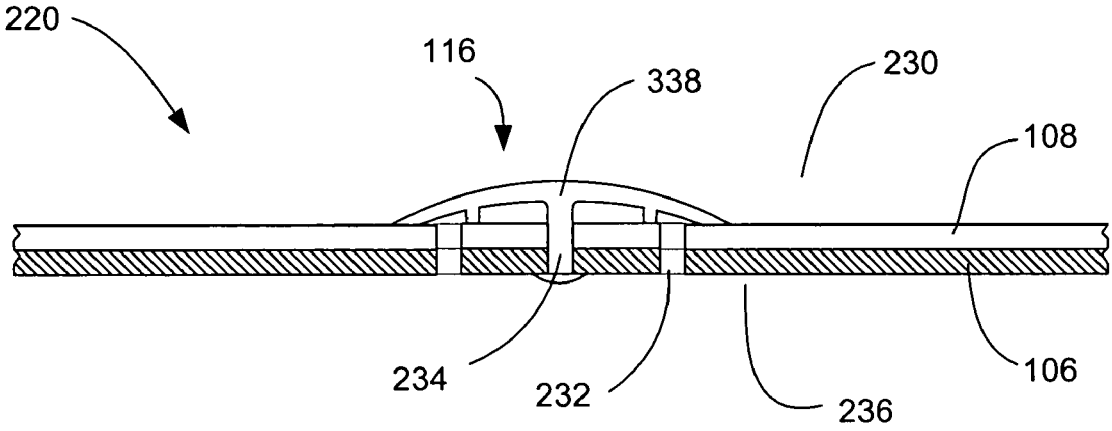
FIGS. 4A and 4B are cross-sections of a portion of a first panel having a relief valve structure in accordance with one embodiment of the present invention.
Figure 4B:
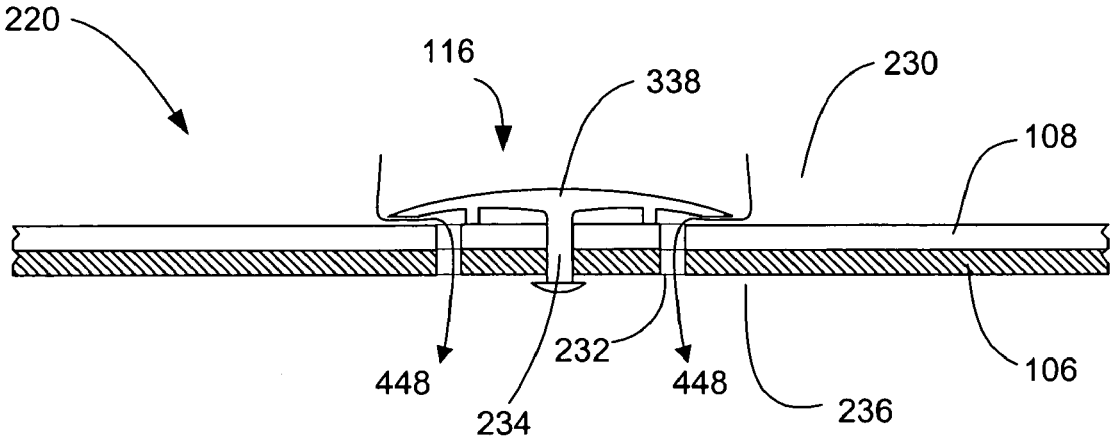
Figure 4C:
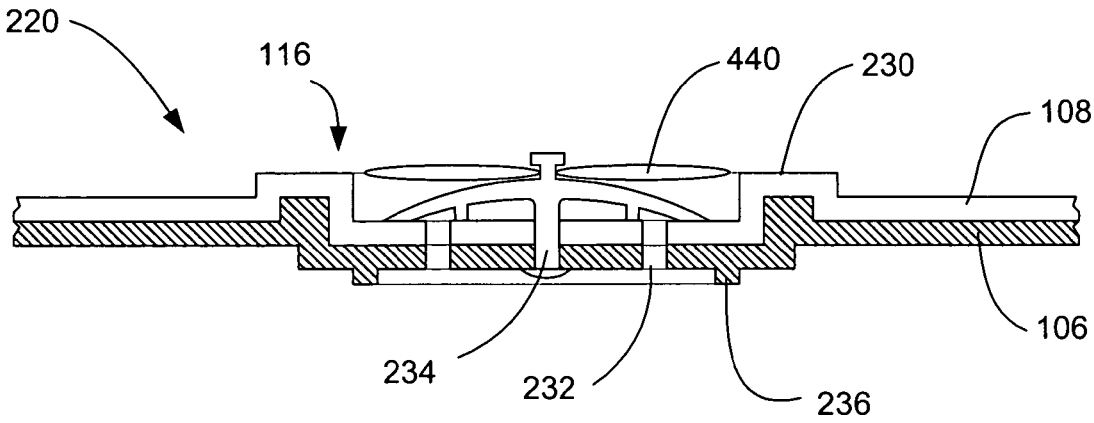
FIGS. 4C and 4D are cross-sections of a portion of a first panel having a whimsical structure in accordance with one embodiment of the present invention.
Figure 4D:
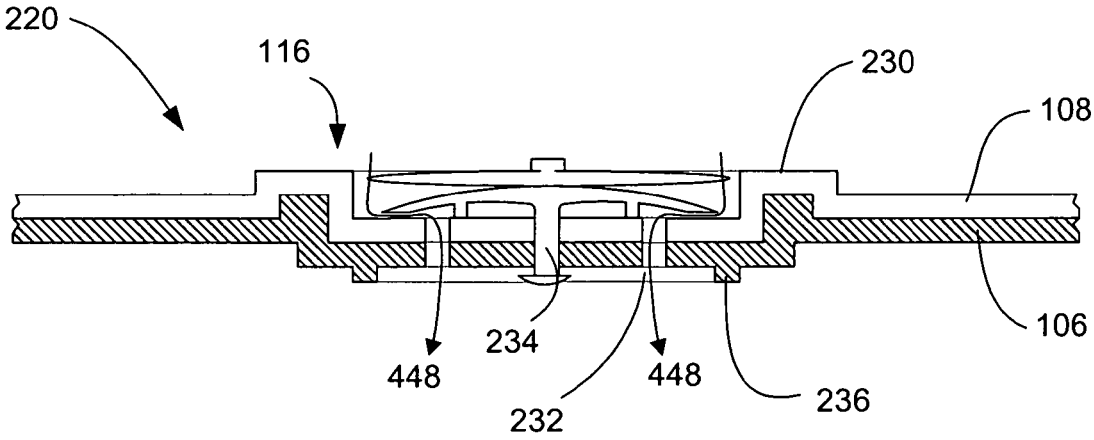

In still other embodiments, a different valve structure can be formed or a structure other than a valve structure can be formed. For example, as shown in FIGS. 4A and 4B, the structure can be a release valve wherein applying pressure to a dome-shaped diaphragm 338 connected with the bag at an attachment point 234 causes a seal to be broken, allowing air 448 (shown schematically) to enter or be evacuated from the bag through apertures 232. In still other embodiments, a recessed area similar to that of the valve structure can include an emblem, or a whimsical feature such as a propeller 444 connected with an attachment point 234 and adapted to rotate when a seal is broken and air rushes into a partially evacuated bag (as shown in FIGS. 4C and 4D).

Figure 5:
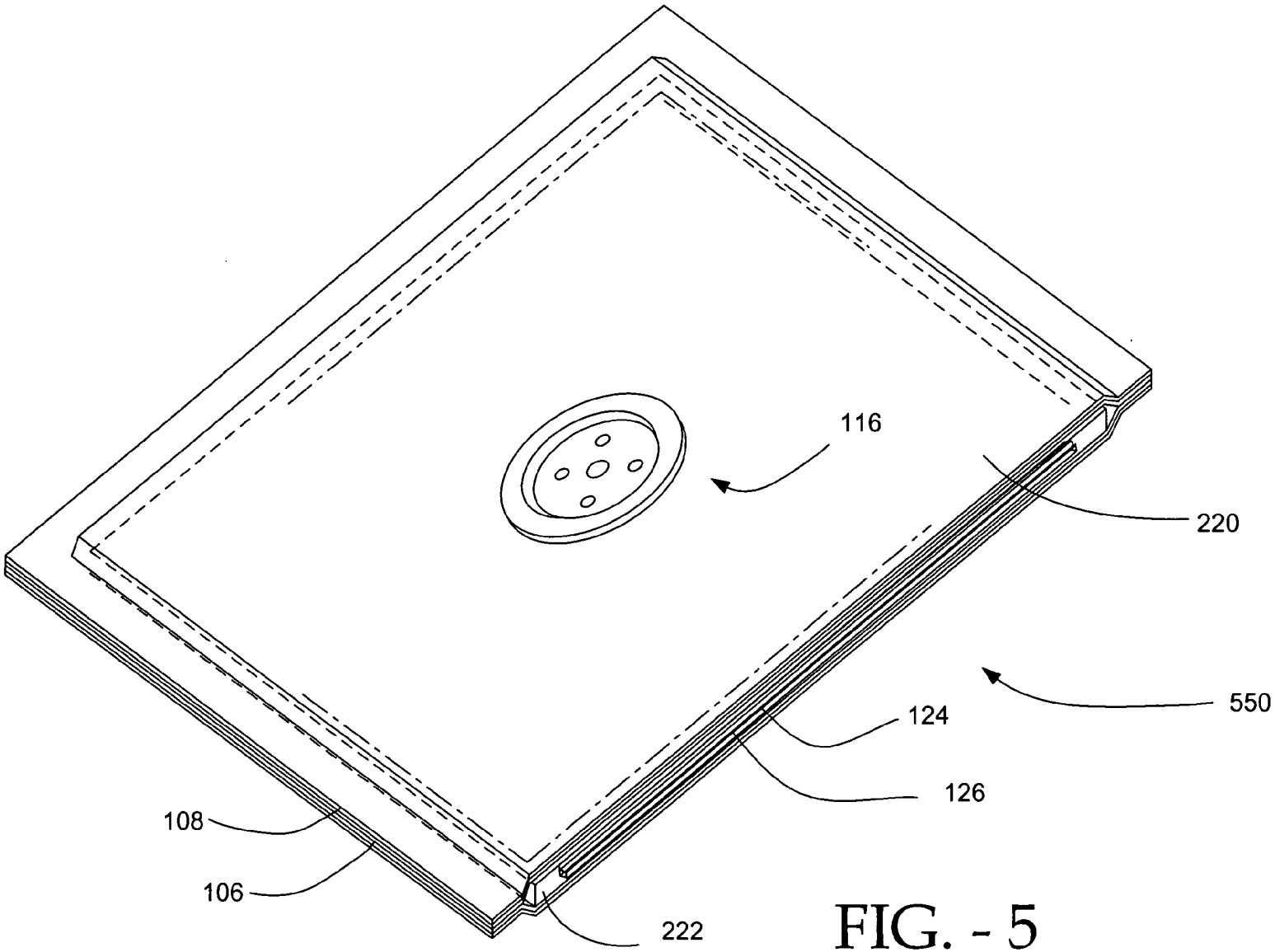
FIG. 5 is a perspective view of a vacuum bag in accordance with one embodiment of the present invention.

FIG. 5 illustrates a bag for use in vacuum packaging in accordance with one embodiment of the present invention. The bag 550 comprises a first panel 220 overlapping a second panel 222, each panel comprising a heat-sealable inner layer 106 and an outer, gas-impermeable base layer 108. At least one receiving feature 126 is formed on the first panel 220 in accordance with an embodiment described above. At least one insertion feature 124 is formed on the second panel 222 in accordance with an embodiment described above, such that the insertion feature 124 can be mated with the receiving feature 126 to form a seal. In other embodiments, each panel can have a plurality of insertion features and receiving features, such that a more secure seal can be obtained. A valve structure 116 is formed on at least one panel 220,222. As described above, in other embodiments, a single panel 220 can be formed having an insertion feature 124, a receiving feature 126, and a valve structure 116 such that the panel 220 can be folded over itself to form the bag 550, thereby reducing tooling costs through the use of a single cooling roll 104.

The lower, left, and right edges of the overlapped first and the second panel 220,222 are bonded to each other by heating, so as to form an envelope for receiving a perishable or other product to be vacuum packaged. A perishable or other product can be packed in the bag through an inlet. The inlet can be sealed by the zipper or clasp, and the air and/or gases can then be evacuated through the valve structure. The seal can be broken by unfastening the zipper or clasp. In this way, the vacuum bag 550 can be repeatedly used. In other embodiments, a zipper or clasp is not included and the inlet is heat sealed. In still other embodiments, the bag 550 can include insertion and receiving features 124,126 but no valve structure 116.

The features and structures described above can be combined with other manufacturing techniques to form indicia or integrated temperature sensors, as described in the cross-referenced provisional applications, incorporated herein by reference.

The foregoing description of preferred embodiments of the present invention has been provided for the purposes of illustration and description. It is not intended to be exhaustive or to limit the invention to the precise forms disclosed. It is to be understood that many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

The invention claimed is:

1. The method of manufacturing a bag adapted to receive an article, comprising:

rotating a first roller having one or both of a plurality of recesses and a plurality of protuberances that define a first structure and a second structure;

wherein the first structure is one of a receiving feature and an insertion feature and the second structure is the other of the receiving feature and the insertion feature;

rotating a second roller adjacent to the first roller, said second roller can feed a first film adjacent to the first roller;

continuously applying a molten material between the first roller and the film;

said molten material and the first film forming within the plurality of recesses of the first roller, and being redistributed by the plurality of protuberances of the first roller, and said molten material and the first film moving between the first roller and the second roller forming a first panel with a first structure and a second structure;

wherein the first and second structure form a mechanism for closing the bag that is substantially transverse to a flow of the first molten material and the first film onto the rollers;

forming a second panel; and mating the first panel to the second panel in order to form a bag.

2. The method of claim 1 including:

using a gas-impermeable material for the film; and using a heat sealable material for the molten material.

3. The method of claim 1, wherein said second panel is formed with the first roller and the second roller.

4. The method of claim 1, wherein said second panel is formed with the first roller and the second roller, and the mating step includes folding the first panel over the second panel.

5. The method of claim 1, wherein the insertion feature and the receiving feature form a zipper.

6. The method of claim 1, wherein the insertion feature and the receiving feature form a clasp.

7. The method of claim 1, wherein the insertion feature and the receiving feature include complimentary teeth.

8. A method for manufacturing a bag adapted to receive an article, comprising:

feeding a first gas-impermeable film to a first nip formed by a first cooling roll and a first laminating roll, the first cooling roll having a plurality of cavities and protuberances for forming a first structure and a second structure;

wherein the first structure is one of a receiving feature and an insertion feature;

wherein the second structure is a valve;

continuously extruding resin such that the resin fills the first nip and the plurality of cavities exposed to the first nip;

pressing the resin and the first gas-impermeable film between the first cooling roll and the first laminating roll;

cooling the resin and forming the resin and the first gas-impermeable film such that a first inner layer having the first structure and the second structure is formed;

wherein the resin adheres to the first gas-impermeable film, thereby forming a first panel;

feeding a second gas-impermeable film to a second nip formed by a second cooling roll and a second laminating roll, the second cooling roll having a plurality of cavities and protuberances for forming a third structure;

wherein the third structure is the other of the receiving feature and the insertion feature;

continuously extruding resin such that the resin fills the second nip and the plurality of cavities exposed to the second nip;

pressing the resin and the second gas-impermeable film between the second cooling roll and the second laminating roll;

cooling the resin and forming the resin and the first gas-impermeable film such that a second inner layer having the third structure is formed;

wherein the resin adheres to the first gas-impermeable film, thereby forming a second panel;

wherein the first and second structure form a mechanism for closing the bag that is substantially transverse to a flow of the resin and the gas-impermeable layers onto the rollers;

overlapping the first panel with the second panel; and applying heat to a first, second, and third side of the first and second panels.

9. A method for forming a bag adapted to receive an article, the bag being partially formed between a laminating roll and a cooling roll having a plurality of cavities and protuberances for forming a first and second structure, comprising:

feeding a gas-impermeable film to a nip formed by the cooling roll and the laminating roll;

continuously extruding resin such that the resin fills the nip and the plurality of cavities exposed to the nip;

pressing the resin and the gas-impermeable film between the cooling roll and the laminating roll such that the plurality of protuberances displaces excess resin material;

cooling the resin and forming the resin and gas-impermeable film such that the resin and the gas-impermeable film forms the first and second structure and the resin adheres to the gas-impermeable film, forming a panel including resin and gas-impermeable film;

wherein the first structure includes one of a receiving feature and an insertion feature and the second structure includes the other of the receiving feature and the insertion feature;

wherein the first and second structure form a mechanism for closing the bag that is substantially transverse to a flow of the resin and the gas-impermeable film onto the rollers;

folding the panel such that a first portion of the panel overlaps a second portion of the panel; and applying heat to a portion of a periphery of the first and second portions such that an envelope is formed.

10. A method for manufacturing a bag adapted to receive an article, comprising:

feeding a first gas-impermeable film to a first nip formed by a first cooling roll and a first laminating roll, the first cooling roll having a plurality of cavities and protuberances for forming a first structure;

wherein the first structure is one of a receiving feature and an insertion feature;

continuously extruding resin such that the resin fills the first nip and the plurality of cavities exposed to the first nip;

pressing the resin and the first gas-impermeable layer between the first cooling roll and the first laminating roll;

cooling the resin and forming the resin and gas-impermeable film such that a first inner layer having the first structure is formed;

wherein the resin adheres to the first gas-impermeable film, thereby forming a first panel including the first structure;

feeding a second gas-impermeable film to a second nip formed by a second cooling roll and a second laminating roll, the second cooling roll having a plurality of cavities and protuberances for forming a second structure;

wherein the second structure is the other of the receiving feature and the insertion feature;

continuously extruding resin such that the resin fills the second nip and the plurality of cavities exposed to the second nip;

pressing the resin between the second cooling roll and the second laminating roll;

cooling the resin and forming the resin and gas-impermeable film such that a second inner layer having the second structure is formed;

wherein the resin adheres to the first gas-impermeable film, thereby forming a second panel;

wherein the first and second structure form a mechanism for closing the bag that is substantially transverse to a flow of the molten material and the gas-impermeable film onto the rollers;

overlapping the first panel with the second panel; and applying heat to a first, second, and third side of the first and second panels.

11. A method for manufacturing a bag adapted to receive an article, comprising:

rotating a first cooling roll at a first rate, the first cooling roll including one or more cavities for forming an insertion feature;

rotating a first laminating roll at a second rate;

introducing a first film to a first nip between the first cooling roll and the first laminating roll;

continuously extruding a molten material to the first nip;

pressing the molten material between the first cooling roll and the first film such that the molten material and the first film fills the plurality of cavities exposed to the first nip;

cooling the molten material and forming the molten material and the first film such that first inner layer is formed;

wherein the first inner layer includes the insertion feature;

wherein the first inner layer forms such that the molten material adheres to the first film, thereby forming a first panel;

rotating a second cooling roll at a third rate, the second cooling roll including one or more protuberances for forming a receiving feature;

rotating a second laminating roll at a fourth rate;

introducing a second film to a second nip between the second cooling roll and the second laminating roll;

continuously extruding a second molten material to the second nip;

pressing the second molten material between the second cooling roll and the second film such that the one or more protuberances exposed to the second nip displace molten material;

cooling the second molten material and forming the second molten material and the second film such that a second inner layer is formed;

wherein the second inner layer includes the receiving feature;

wherein the second inner layer forms such that the second molten material adheres to the second film, thereby forming a second panel;

wherein the insertion feature and the receiving feature form a mechanism for closing the bag that is substantially transverse to a flow of the molten material and the gas-impermeable film onto the rollers;

overlapping the first panel with the second panel; and applying heat to a portion of a periphery of the first and second panels such that the first panel and the second panel form an envelope.

12. The method of claim 11, wherein the second rate is an integer multiple of the first rate and the fourth rate is an integer multiple of the third rate.

13. The method of claim 11, wherein the first film and the second film comprise at least one layer.

14. The method of claim 13, wherein the at least one layer comprises a gas-impermeable material.

15. The method of claim 14, wherein the gas-impermeable material is one of polyester, polyamide, ethylene vinyl alcohol, and nylon.

16. The method of claim 11, wherein the molten material is polyethylene.

17. The method of claim 11, wherein a thickness of the first inner layer is determined by the size of the first nip and the thickness of the second inner layer is determined by the size of the second nip.

18. The method of claim 11, wherein the insertion feature and the receiving feature form a zipper.

19. The method of claim 11, wherein the insertion feature and the receiving feature form a clasp.

* * * * *